United States Patent [19]

Nordblad et al.

[11] 4,160,527

[45] Jul. 10, 1979

[54] APPARATUS FOR REPLACEMENT OF A CABLE DRUM OR SIMILAR OBJECT ON A SHAFT WITH ANOTHER CABLE DRUM

[75] Inventors: Sven S. Nordblad, Spånga; Karl-Erik Svensson, Hägersten, both of Sweden

[73] Assignee: Telefonaktiebolaget L M Ericsson, Stockholm, Sweden

[21] Appl. No.: 848,811

[22] Filed: Nov. 7, 1977

[30] Foreign Application Priority Data

Nov. 18, 1976 [SE] Sweden ..... 7612929

[51] Int. Cl.[2] ..... B65H 67/00

[52] U.S. Cl. ..... 242/47; 29/244; 242/1; 242/81

[58] Field of Search ..... 242/47, 1, 18 R, 18 DD, 242/25 R, 41, 54 R, 55, 78, 78.1, 79, 81, 58.6; 29/244, 252, 256, 258, 262, 278, 280, 427; 214/1.1

[56] References Cited

U.S. PATENT DOCUMENTS

| | | | |
|---|---|---|---|
| 1,305,322 | 6/1919 | Towler | 29/258 |
| 2,467,982 | 4/1949 | Maris | 29/263 X |
| 2,821,777 | 2/1958 | Keister | 29/259 |
| 3,131,880 | 5/1964 | Miller et al. | 242/81 X |
| 3,200,483 | 8/1965 | Menegoni | 29/259 |
| 3,579,796 | 5/1971 | Fillion | 29/263 |
| 3,742,568 | 7/1973 | Hahlbeck | 29/252 X |
| 3,964,723 | 6/1976 | Schippers et al. | 242/41 X |
| 4,022,392 | 5/1977 | Thomas, Jr. et al. | 242/18 DD X |

FOREIGN PATENT DOCUMENTS

| | | | |
|---|---|---|---|
| 25908 | 3/1923 | France | 29/278 |

*Primary Examiner*—Stanley N. Gilreath

*Attorney, Agent, or Firm*—Hane, Roberts, Spiecens & Cohen

[57] ABSTRACT

Apparatus for replacement of a winding bobbin on a shaft comprising a controllable arm for transport of bobbins to and from the shaft. The arm has a first number of grip members and a second number of grip members. The first number of grip members is symmetrically and peripherily placed relative to the arm and intended for engaging a bobbin. The second number of grip members is symmetrically and centrally placed relative to the arm and intended for fastening at a locking mechanism associated with the shaft, the locking mechanism being in a locking positon or a neutral position in dependence on the operation of the second number of grip members.

7 Claims, 4 Drawing Figures

APPARATUS FOR REPLACEMENT OF A CABLE DRUM OR SIMILAR OBJECT ON A SHAFT WITH ANOTHER CABLE DRUM

FIELD OF THE INVENTION

This invention relates to apparatus for replacing an object fixed on a shaft with another similar object.

The apparatus comprises an automatically controlled arm for bringing objects to and from the shaft. Particularly, the invention relates to an arrangement for handling drums or bobbins with flanges which are to be engaged or disengaged with a spooling machine for wires, conductors, cables and similar objects. The spooling machine is, in this case, arranged with a motor-driven shaft mounted in bearings at one of its ends so that a drum or a bobbin can be engaged on the shaft, one side of the bobbin, viz., the side at the free end of the shaft, being totally free. A locking device is necessary at the shaft end so that the bobbin cannot slip away during spooling.

PRIOR ART

Programable picking arrangements are known per se, which arrangements are provided with transferring devices adapted for a special product.

SUMMARY OF THE INVENTION

An object of this invention is to provide apparatus which is specially suitable for spooling or similar arrangements. The characteristic features for an arrangement designed according to the invention appear from the appended claims.

BRIEF DESCRIPTION OF THE DRAWINGS

The invention will be described more in detail in connection with the accompanying drawings, where.

DETAILED DESCRIPTION

Figure 1:
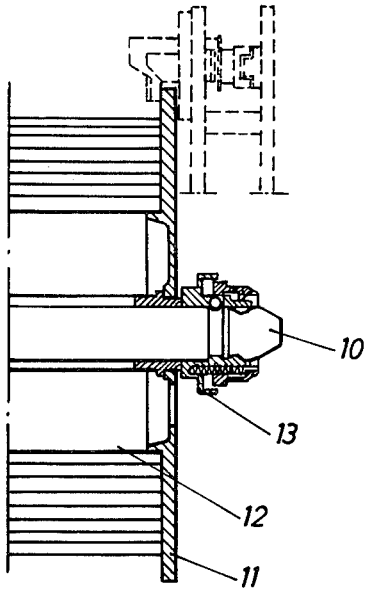
FIG. 1 is an elevational view, partly in section, of a spooling arrangement, FIG. 2 a sectional view of a locking arrangement associated wth the spooling arrangement.

In FIG. 1 reference numeral 10 designates the free end of a shaft of a spooling arrangement. The other end of the shaft, not shown, is motor-driven and mounted in the spooling arrangement. On the shaft a bobbin is threaded, one flange 11 of which and part of the core 12 connecting two flanges of the bobbin are shown in the drawing. The bobbin is fastened to the shaft by a locking device 13.

Figure 2:
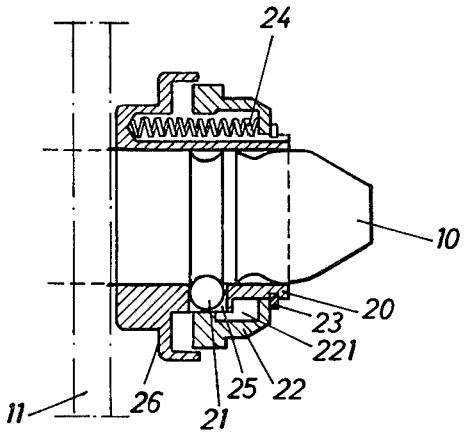

As appears from FIG. 2 the locking device consists of a casing part 20 with holes 25 for a number of steel balls 21, a locking ring 22 arranged on the casing part 20, and a stop ring 23 against which the locking ring 22 is pressed by means of a number of springs, one of which is shown at 24. In the of position the locking device in FIG. 2, the steel balls 21 prevent the locking device 13 and therewith the bobbin according to FIG. 1, to be displaced relative to the shaft 10. Upon displacement of the locking ring 22 to the left against the pressure of the springs 24 a notch 221 in the locking ring 22 comes the balls 21 which then can be displaced radially outwards displacement of the locking device 13 (to the right) relative to the shaft 10. The bobbin can then be removed from the assembly and replaced with another empty bobbin.

Figure 3:
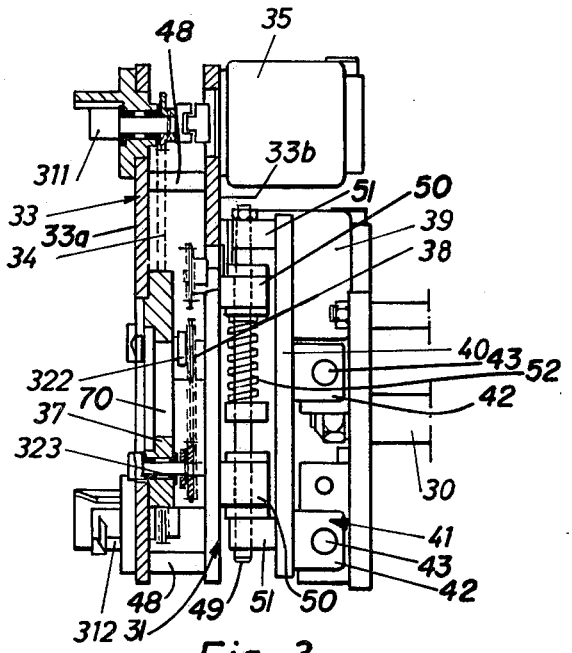
FIG. 3 shows, partly in section, bobbin replacing apparatus in accordance with the invention.
Figure 4:
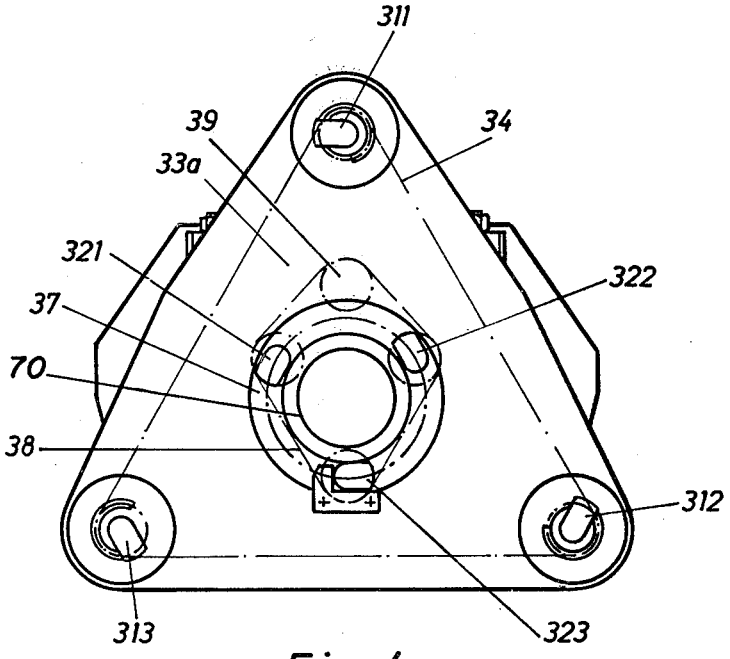
FIG. 4 is a front view of the apparatus in FIG. 3.

The arrangement according to FIGS. 3–4 comprises an automatically controlled arm 30, a first number of catch devices 311, 312, 313 and a second number of catch devices 321, 322, 323.

The catch devices 311, 312, 313 are arranged on a common plate 33*a* of a plate assembly 33 which includes a second plate 33*b* secured to plate 33*a* by connectors 48. The plate assembly 33 in turn is elastically connected with a plate 40 by elastic connection 31 so that the plate 33*a* with the catch devices 311, 312, 313 can be displaced vertically and perpendicularly to the longitudinal axis of the arm 30 for any centering with the shaft 10 of the spooling machine that need be made. More particularly, the elastic connection between plate 40 and assembly 33 comprises a shaft 49 fixed to plate 40 by lugs 51, and guides 50 secured to plate 33*b* and slidably receiving shaft 49. A spring 52 acts between a guide 50 and a stop 53 secured to the shaft 49 and permits relative movement of assembly 33 in a direction parallel to shaft 49 i.e. perpendicular to arm 30. The plate 40 is elastically connected via a similar elastic connection 41 to the arm 30 for horizontal regulation i.e. for relative movement of the catch arrangement relative to the shaft 10. The elastic connection 41 extends perpendicularly to elastic connection 31 and visible in FIG. 3 are guides 42 fixed to plate 40 and shafts 43 secured to plate 61 affixed to arm 30. When the arrangement shown in FIG. 3 is displaced to the left, a bore 70 in plate 37 engages the conical end of shaft 10 and the catch arrangement can be displaced vertically and horizontally if the bore 70 is not coaxial with shaft 10. The catch devices may be course be arranged in many different ways for magnetic and/or mechanical engagement with the flange of the bobbin. The arrangement shown in the drawing consists of three L-shaped catch clutches arranged to come into or out of engagement with the flange of the bobbin after turning. The turning is performed with a chain 34 engaged around all the catch clutches which chain is driven by a motor 35 secured to plate 33*b*. In FIG. 1 at the top to the right is shown in dotted lines a part of the catch arrangement with the catch device 311 turned so that one of its "legs" extends a distance over that side of the flange 11 which is remote from the catch arrangement.

The catch devices 321, 322, 323 are arranged on a common plate 37 secured to plate 33*a*, and consist of L-shaped devices which are simultaneously driven by a chain 38 from a motor 39 secured to plate 33*b*. These devices come into engagement with the surface 26 of the casing part 20 of the locking device upon turning of the L-shaped devices and to a locking position and come into a release position when the L-shaped devices are returned to initial position for change of the bobbin on the shaft 10. When the bobbin is to be changed on the spooling machine the changing arrangement is engaged on the conical end of the shaft 10 and is brought towards the spooling machine with the arm 30 in line with the shaft 10. After centering and axial displacement of the catch arrangement on shaft 10, the plate 33*b* contacts the shoulder 29 on ring 22 and further axial displacement of the catch arrangement causes the locking ring 22 to be displaced to the left relative to the casing part 20 so that the balls 21 can be displaced radially outwards. The catch devices 321, 322, 323 reach the ring shaped surface 26 of the casing part 20, see FIG. 2, and are then turned by the motor 39 and the chain 38 so that one "leg" of said L-shaped devices extend behind the surface 26. At the same time the catch devices 311, 312 and 313 are in engagement with the flange of the bobbin as earlier described. The changing arrangement is now brought to the right to bring with it the locking device 13 as well as the bobbin 11-12. The latter is placed in storage and from another storage is collected an empty bobbin 11-12. Hereby the motor 35 and the chain 35 produce the necessary movement of the catch devices 311, 312, 313. The new empty bobbin is engaged on the shaft 10, the catch devices 311, 312, 313, as well as the catch devices 321, 322, 323 are brought out of engagement with the flange 11 and the locking device 13 respectively and the changing arrangement is removed from the spooling machine and the empty bobbin is kept in place by the locking device in its locking position.

We claim:

1. Apparatus for replacing an object secured to a shaft with a similar object, said apparatus comprising locking means releasably attachable to the shaft for holding an object on said shaft, said locking means including an actuable release member for releasing the locking means from said shaft, a displaceable control arm, first catch means coupled to said arm for movement therewith for releasably engaging the object secured to said shaft, second catch means coupled to said arm for movement therewith for releasably engaging said locking means, and means coupled to said arm for actuating said release member when said first and second catch means are positioned by said arm for respectively releasably engaging said object and said locking means.

2. Apparatus as claimed in claim 1 wherein said first and second catch means respectively include a plurality of catch devices symmetrically arranged around said arm.

3. Apparatus as claimed in claim 2 wherein said catch devices include turnable L-shaped catch members.

4. Apparatus as claimed in claim 3 wherein the turnable catch members of the second catch means are positioned for engaging said locking means when the locking means is released from the shaft.

5. Apparatus as claimed in claim 3 comprising means for turning the catch members of the first and second catch means respectively in unison.

6. Apparatus as claimed in claim 1 comprising means elastically connecting the first and second catch means to the arm for centering the arm coaxially with the shaft and thereby positioning the first and second catch means respectively with the object and the locking means.

7. Apparatus as claimed in claim 2 wherein the catch devices of each catch means are three in number.

* * * * *